US006330763B1

(12) United States Patent
Kern et al.

(10) Patent No.: US 6,330,763 B1
(45) Date of Patent: Dec. 18, 2001

(54) TRANSLATING DOOR WITH DISENGAGEABLE SEALS

(75) Inventors: Rodney Kern, Dubuque; Dave Leppert, Zwingle, both of IA (US); Peter Schulte, East Dubuque, IL (US); James Schwingle, Cuba City, WI (US); Dean Shanahan, Dubuque, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 09/394,796

(22) Filed: Sep. 10, 1999

(51) Int. Cl.[7] ..... E05D 15/06

(52) U.S. Cl. ..... 49/231; 49/226; 49/370

(58) Field of Search ..... 49/125, 226, 227, 49/228, 231, 475.1, 498.1, 483.1, 366, 370, 9; 160/192, 202, 211, 216

(56) References Cited

U.S. PATENT DOCUMENTS

| | | | | |
|---|---|---|---|---|
| 643,307 | | 2/1900 | Schmitt | 160/197 |
| 843,011 | | 2/1907 | Hale et al. | 160/190 |
| 1,220,910 | | 3/1917 | Toll | 160/190 |
| 1,245,882 | | 11/1917 | Davis | 49/102 |
| 1,406,951 | | 2/1922 | Fehr . | |
| 1,439,373 | | 12/1922 | Norwood et al. | 160/224 |
| 1,534,210 | | 4/1925 | Griffith et al. | 491/102 |
| 1,681,545 | | 8/1928 | Lang | 49/102 |
| 1,960,860 | | 5/1934 | Allen | 160/197 |
| 2,373,023 | | 4/1945 | Goodwin | 49/102 |
| 2,425,016 | | 8/1947 | Weaver | 49/102 |
| 2,517,713 | | 8/1950 | Rissler | 187/31 |
| 2,811,406 | | 9/1957 | Moore et al. | 312/296 |
| 2,878,532 | * | 3/1959 | Clark | 49/228 X |
| 3,065,826 | | 11/1962 | Tucker, Jr. | 187/52 |
| 3,074,124 | | 1/1963 | Bergstedt | 20/19 |
| 3,175,254 | * | 3/1965 | Bromann | 49/228 |
| 3,197,817 | | 8/1965 | Voris | 20/19 |
| 3,425,162 | | 2/1969 | Halpern | 49/125 |
| 3,432,966 | | 3/1969 | Bordner | 49/368 |

(List continued on next page.)

FOREIGN PATENT DOCUMENTS

| | | | |
|---|---|---|---|
| 196048 | 2/1938 | (CH) . | |
| 573632 | 3/1933 | (DE) | 49/102 |
| 0 478 938 A1 | 8/1991 | (EP) . | |
| 980892 | 5/1951 | (FR) | 49/102 |
| 1514166 | 1/1968 | (FR) . | |
| 2191010 | 2/1974 | (FR) . | |
| 2315-598 | 6/1975 | (FR) . | |
| 2582-343 | 5/1985 | (FR) . | |
| 2 219 618 | 12/1989 | (GB) . | |
| 5-118180 | 5/1993 | (JP) . | |
| 6-72681 | 3/1994 | (JP) . | |
| 6032572 | 5/1994 | (JP) . | |

OTHER PUBLICATIONS

*Jamison Sound Reduction, Special Purpose, Cold Storage Doors* brochure, Jamison Door Company, 1988, 8 pages.

*Introducing The SST Smooth Operator System* brochure, Therm–L–Tec Systems, Inc., 6 pages, 1990.

*International Search Report*, International Application Serial No. PCT/US00/25030 corresponding to U.S. Serial No. 09/394,796, European Patent Office, dated Dec. 17, 2000, 8 pages.

*Primary Examiner*—Jerry Redman
(74) *Attorney, Agent, or Firm*—Marshall, Gerstein & Borun

(57) ABSTRACT

A generally horizontally sliding door includes a sliding or otherwise translating door panel with a full-perimeter seal that engages sealing surfaces upon closing and at least partially disengages the surfaces upon opening. The door panel travels along an overhead track that is slightly inclined to lower the panel's upper and lower edge seals into engagement with sealing surfaces as the door closes. To provide a substantially full-perimeter seal, a leading edge seal and a trailing edge seal engage sealing surfaces as well. Some of the edge seals are joined to create corner seals. The seals are adapted for single panel sliding doors, bi-parting doors, multi-panel doors, and various combinations thereof.

13 Claims, 9 Drawing Sheets

U.S. PATENT DOCUMENTS

| | | | | |
|---|---|---|---|---|
| 3,460,290 | | 8/1969 | Wutzke | 49/411 |
| 3,529,382 | | 9/1970 | Salvarola | 160/197 |
| 3,611,637 | | 10/1971 | Saino | 49/235 |
| 3,734,238 | | 5/1973 | Secresty et al. | 187/1 |
| 3,805,450 | * | 4/1974 | Forgina | 49/231 |
| 3,807,480 | | 4/1974 | Smart | 160/1 |
| 3,817,161 | | 6/1974 | Koplon | 98/39 |
| 3,912,049 | | 10/1975 | Holland et al. | 187/61 |
| 4,058,191 | | 11/1977 | Balbo | 187/1 |
| 4,115,953 | | 9/1978 | Brosenius | 49/125 |
| 4,180,942 | * | 1/1980 | Saucier | 49/125 |
| 4,218,104 | | 8/1980 | Anderson et al. | 312/214 |
| 4,404,770 | | 9/1983 | Markus | 49/235 |
| 4,592,270 | | 6/1986 | Vener | 98/39 |
| 4,637,176 | | 1/1987 | Acock, Jr. | 52/30 |
| 4,646,471 | * | 3/1987 | Shaiu | 49/231 |
| 4,651,469 | | 3/1987 | Ngian et al. | 49/233 |
| 4,735,293 | | 4/1988 | Everhart et al. | 187/56 |
| 4,758,299 | | 7/1988 | Burke | 156/313 |
| 4,961,454 | | 10/1990 | Reilly, Jr. et al. | 160/344 |
| 4,987,638 | | 1/1991 | Ribaudo | 16/89 |
| 5,080,950 | | 1/1992 | Burke | 428/81 |
| 5,083,639 | | 1/1992 | Kappeler | 187/51 |
| 5,165,142 | | 11/1992 | Pilsbury | 16/90 |
| 5,195,594 | | 3/1993 | Allen et al. | 169/48 |
| 5,305,855 | | 4/1994 | Rivera et al. | 187/56 |
| 5,347,755 | * | 9/1994 | Jaster et al. | 49/280 X |
| 5,383,510 | | 1/1995 | Allen | 160/310 |
| 5,427,205 | | 6/1995 | Saillio et al. | 187/334 |
| 5,899,303 | | 5/1999 | Allen | 187/333 |

* cited by examiner

TRANSLATING DOOR WITH DISENGAGEABLE SEALS

BACKGROUND OF THE INVENTION

1. Field of the Invention

The subject invention generally pertains to what is known as a horizontally sliding door and more specifically to a seal for such a door.

2. Description of Related Art

So-called horizontally sliding doors (which actually may slide or roll) usually include one or more door panels that are suspended by carriages that travel along an overhead track. The carriages allow the door panels to slide or roll in a generally horizontal direction in front of a doorway to open and close the door. The movement of the panels can be powered or manually operated. Depending on the width of the doorway and the space along either side of it, a sliding door can assume a variety of configurations.

For a relatively narrow doorway with adequate space alongside to receive an opening door panel, a single door panel is enough to cover the doorway. Wider doorways with limited side space may require a bi-parting sliding door that includes at least two panels each moving in opposite directions from either side of the doorway and meeting at the center of the doorway to close the door. For even wider doorways or those with even less side space, multi-panel sliding doors can be used. Multi-panel doors have at least two parallel door panels that overlay each other at one side of the doorway when the door is open. To close the door, one panel slides out from behind the other as both panels move in front of the doorway to cover a span of about twice the width of a single panel. Applying such an arrangement to both sides of the doorway provides a bi-parting door with multiple panels on each side.

Although sliding doors are used in a wide variety of applications, they are often used to provide access to cold-storage lockers, which are rooms that provide large-scale refrigerated storage for the food industry. Doorways into such a room are often rather wide to allow forklift trucks to quickly move large quantities of products in and out of the room. The sliding doors are usually power actuated for minimizing the time in which the door is open for the forklift, thus minimizing the amount of cool air that can escape when the door is open. To further minimize the cooling load of the room, the door panels should be thermally insulated and completely sealed around their entire perimeter.

However a tightly sealed door can create frictional drag against mating sealing surfaces as the door opens and closes. Frictional drag can slow the operation of the door and can also create abrasive wear on the sealing surfaces. Unfortunately, increasing the hardness and wear resistance of the seal typically reduces its ability to flex and conform to its mating sealing surface, thus reducing its ability to seal. On the other hand, making a seal relatively soft and compliant may improve its ability to seal, but often reduces its wear resistance.

For effective sealing, mating seals need to be properly aligned to each other. This is done by properly aligning the door panels that move the seals into position. Unfortunately, it is not uncommon for a forklift or other vehicles to accidentally crash through a closed door. This obviously dislodges the alignment of the door panels and often disengages the seals in an abnormal direction. Separating seals in this manner often involves extreme deformation of the seals.

If the panels can not be readily realigned or the seals do not recover their original shape after the impact, the seal's ability to seal diminishes.

SUMMARY OF THE INVENTION

In order to effectively seal a sliding door, a door panel is provided with a seal that includes a lip that overlaps a mating seal. The seals are sufficiently rigid to help keep the door panel properly positioned, yet are sufficiently compressible and resilient to provide effective sealing, even after being temporarily deformed by an impact.

In some embodiments, an upper edge seal, a lower edge seal, a leading edge seal and a trailing edge seal are disposed about a perimeter of a sliding door panel and together the seals alternately engage and disengage various sealing surfaces as the door panel respectively closes and opens.

In some embodiments, a corner seal provides a continuous seal at an intersection between an upper edge seal and a trailing edge seal of a door panel.

In some embodiments, a sliding door includes mating seals whose compliance and geometry accommodate their misalignment by providing a compressive force between the seals in a direction outside the plane along which the panel moves. This compressive force may either help properly align the seals, or may be used to enhance the sealing itself.

In some embodiments, a sliding door panel rotates slightly about a generally horizontal axis to pivot a lower edge seal of the panel away from a lower sealing surface as the panel translates from a closed position to an open position.

In some embodiments, a sliding restraint system is included to provide gross positioning/guiding of the panels, and to improve the door's ability to readily recover from an impact.

DESCRIPTION OF THE PREFERRED EMBODIMENT

Figure 1:
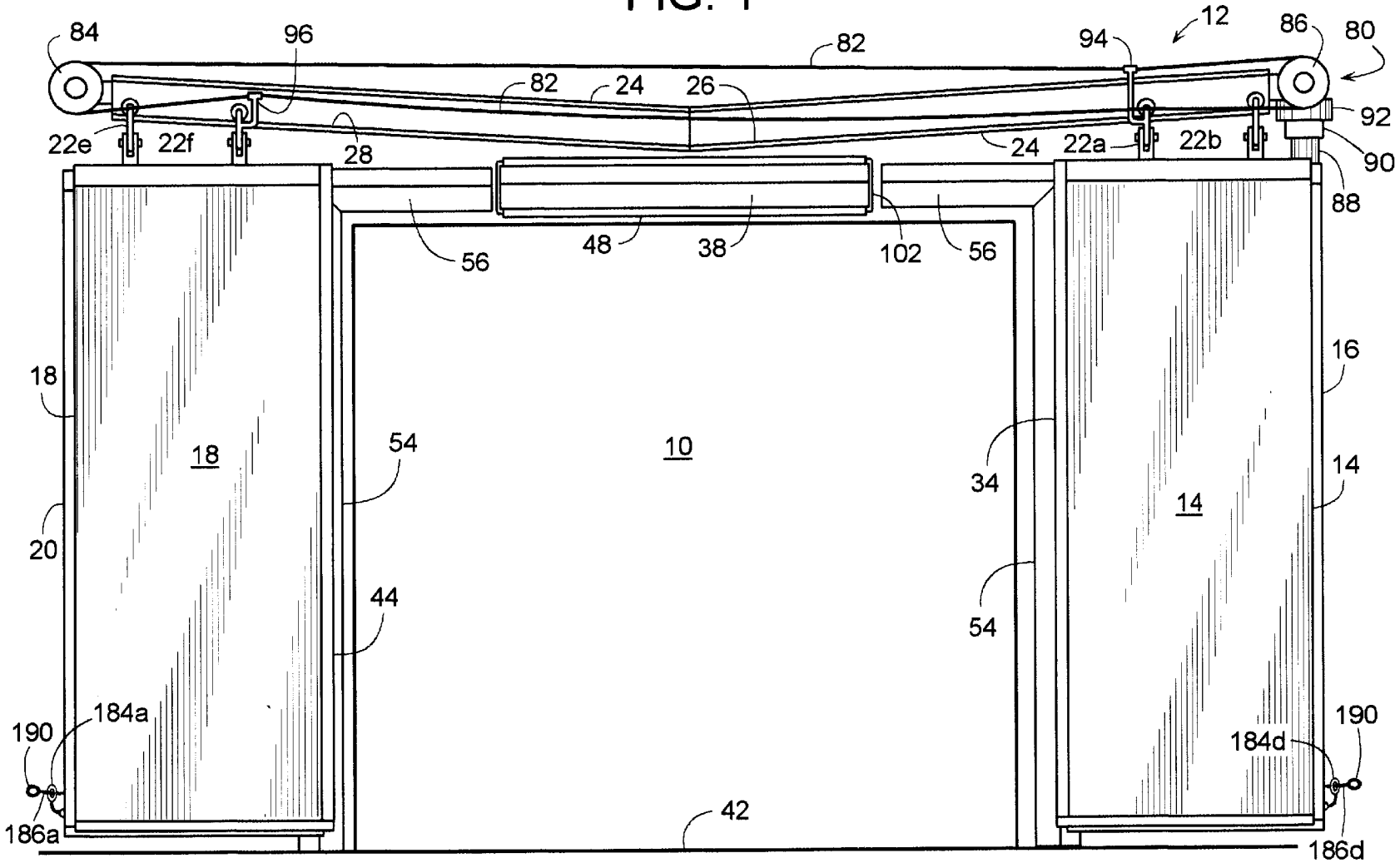
FIG. 1 is a front view of a mult-panel, bi-parting sliding door in an open position.
Figure 2:
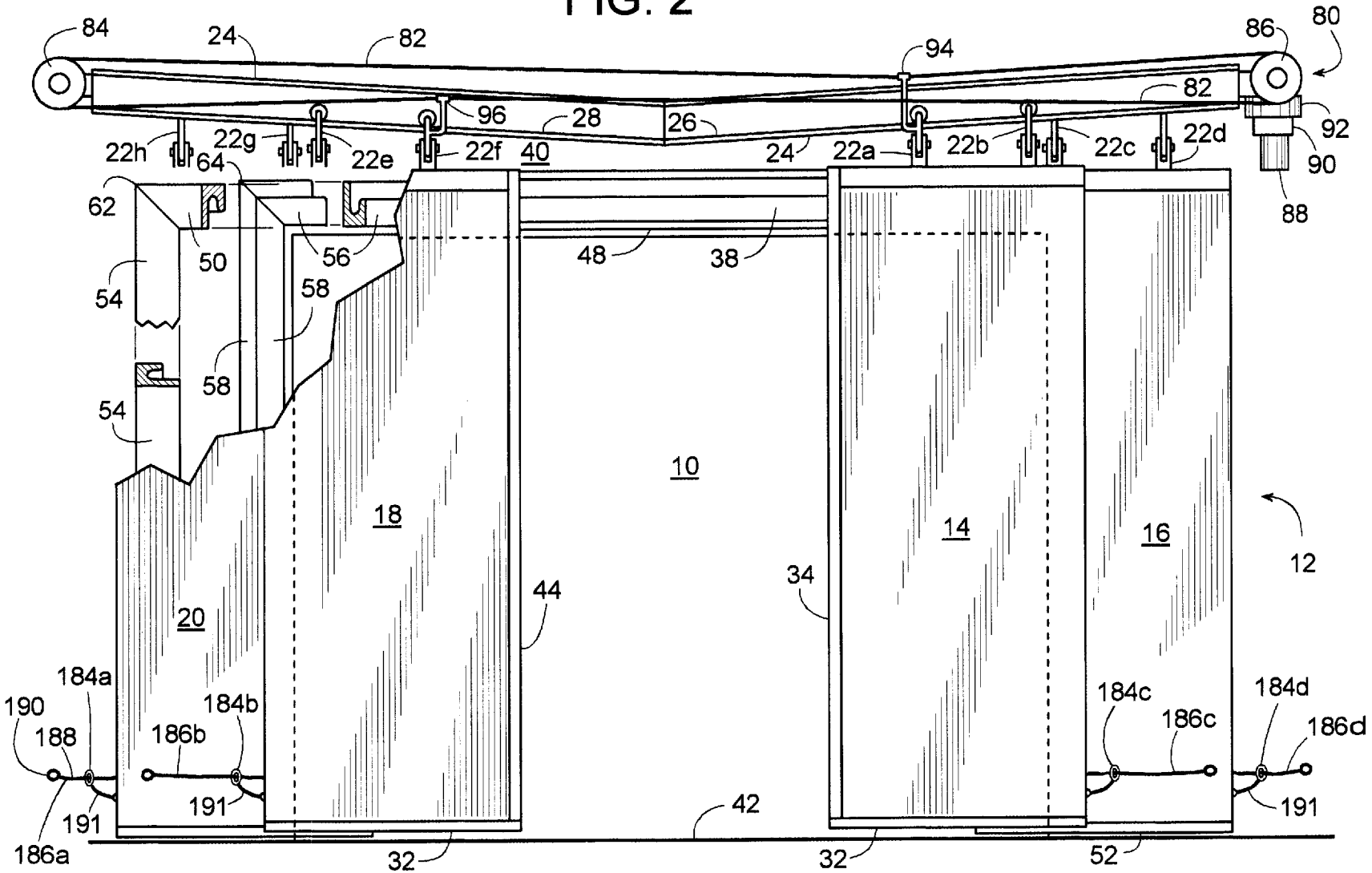
FIG. 2 is a front view of the embodiment of FIG. 1, but with the door between its fully open and fully closed positions. Part of the left side of the door is cut away to show sectional views of its seals.
Figure 3:
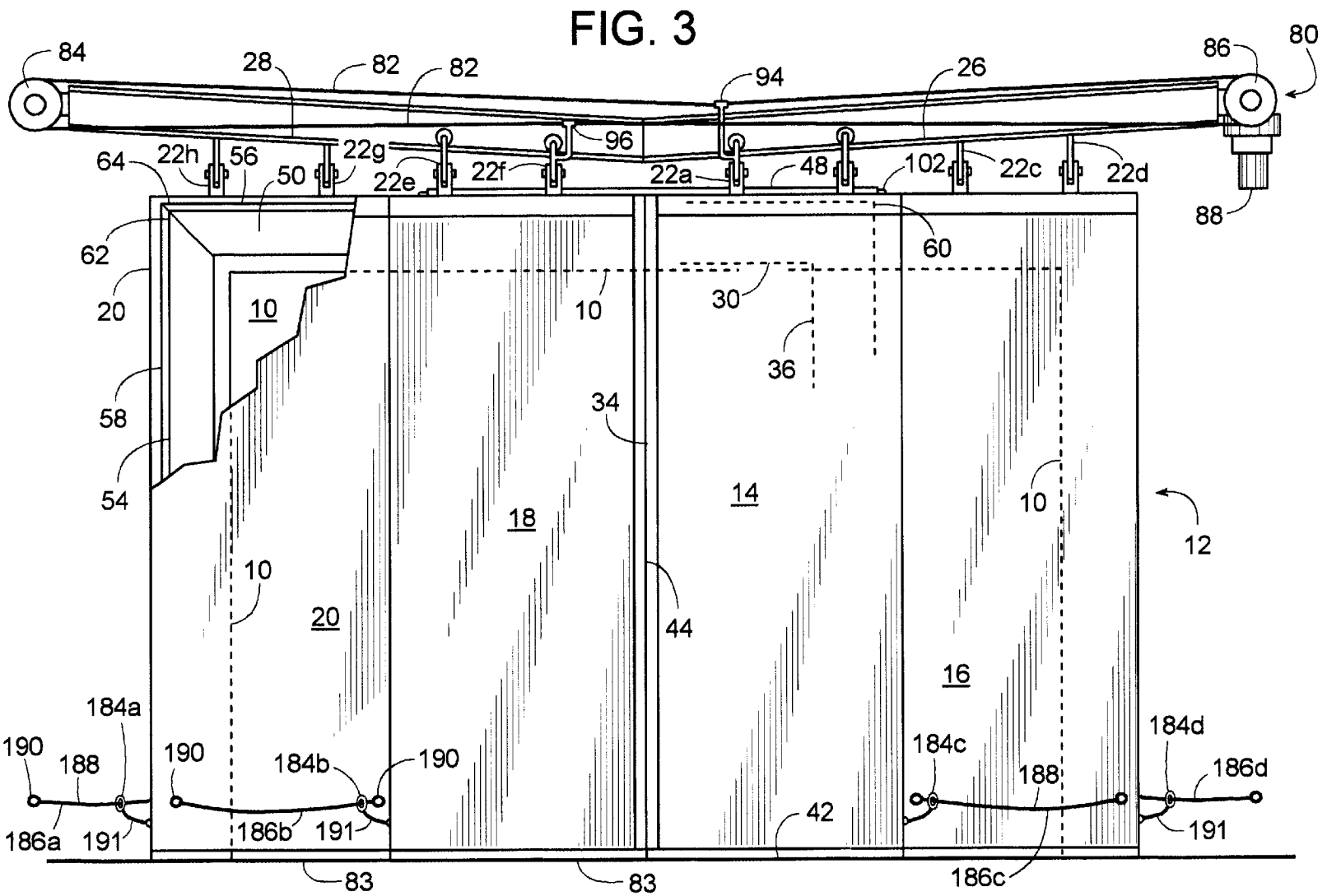
FIG. 3 is a front view of the embodiment of FIG. 1, but with the door in its closed position and part of the left side of the door cut away to show its seals engaged.

To seal off a doorway 10 leading to a cold storage locker or other area within a building, a laterally-moving door such as sliding door 12 is installed adjacent the doorway, as shown FIGS. 1, 2 and 3 with door 12 being shown in an open position, a partially open position, and a closed position respectively. The terms, "sliding door" and "laterally-moving door" refers to those doors that open and close by virtue of a door panel that moves primarily horizontally in front of a doorway without a significant amount of pivotal motion about a vertical axis. The horizontal movement can be provided by any of a variety of actions including, but not limited to sliding and rolling. Moreover, door 12 does not necessarily have to be associated with a cold storage locker, as it can be used to separate any two areas within a building or used to separate the inside of a building from the outside. Although door 12 will be described with reference to a combination multi-panel, bi-parting door, it should be appreciated by those of ordinary skill in the art that the invention is readily applied to a variety of other sliding doors including, but not limited to multi-panel sliding doors, bi-parting doors, and single-panel sliding doors.

As for the illustrated embodiment, door 12 opens and closes by way of four panels 14, 16, 18 and 20 that are mounted for translation in front of doorway 10. In moving between a doorway blocking position (FIGS. 3 and 9) and an unblocking position (FIGS. 1 and 4), panels 14 and 18 generally sweep across a plane 15, and panels 16 and 20 generally sweep across another plane 17 that is generally parallel and offset to plane 15. The specific structure of the panels and their properties such as rigidity and thermal insulating properties can vary widely depending on the application; however, in this example panels 14, 16, 18 and 20 each include a polyurethane foam core encased within a protective outer skin. The translation is provided by suspending the panels from trolleys 22*a–h* that roll along a track 24 mounted overhead, generally above doorway 10. To close door 12, trolleys 22*a–d* roll along a track surface 26 to move panels 14 and 16 to the left (as viewed in FIGS. 1, 2, 3 and 11), and trolleys 22*e–h* roll along another track surface 28 to move panels 18 and 20 to the right until panels 14 and 18 meet at generally the center of doorway 10. The term, "track surface" refers to any surface that supports and/or guides a translating door panel carrier. Examples of a door panel carrier include, but are not limited to, a sliding carriage and a rolling trolley. In some embodiments, one or more track surfaces can be provided by a single overhead track, and multiple track surfaces can be separated or joined in a collinear or angled relationship with each other. For the embodiment of FIGS. 1–3, track surfaces 26 and 28 are provided by track 24 (an assembly) and decline toward the center of the doorway to provide panels 14, 16, 18 and 20 with some vertical movement as the trolleys travel along the track surfaces. The vertical movement facilitates the engagement of seals when door 12 closes and disengagement when it opens.

Figure 4:
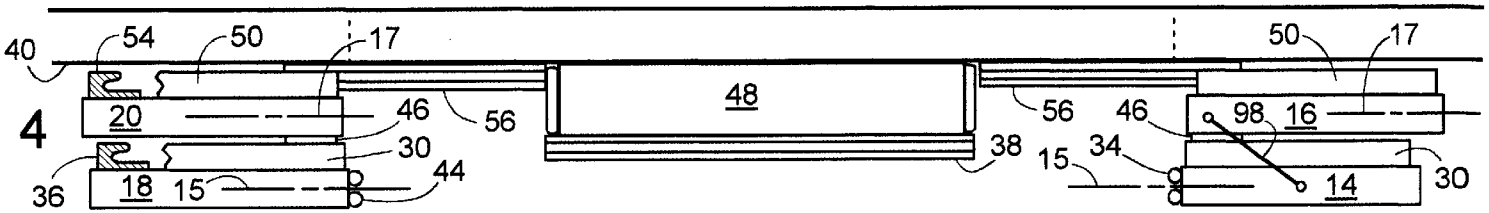
FIG. 4 is a top view of the embodiment of FIG. 1 with the door fully open, but with the track and some other details omitted for clarity.
Figure 5:
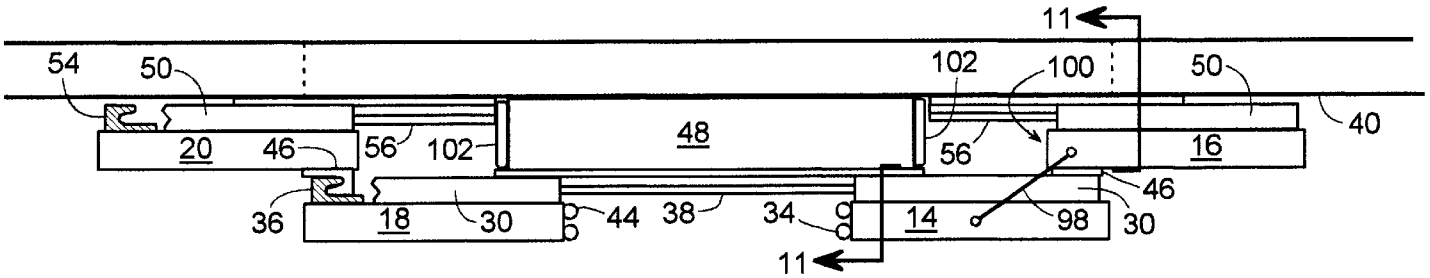
FIG. 5 is a top view similar to that of FIG. 4, but showing the door partially open and moving to its closed position.

To effectively seal door 12 when it is closed in front of doorway 10, each door panel is provided with several seals or sealing surfaces around its general perimeter. Referring to FIGS. 2, 4 and 5, the left-side lead panel 18 includes a first upper edge seal 30, a first lower edge seal 32, a first leading edge seal 44 and a first trailing edge seal 36, which upon panel 18 closing respectively engage a first upper sealing surface 38 coupled to a wall 40, a lower sealing surface 42 (e.g., the floor), a forward sealing surface 34 running along a leading edge of panel 14, and a rear sealing surface 46 disposed adjacent a leading edge of panel 20. The first upper sealing surface 38 is coupled to wall 40 by way of a protruding lintel 48 situated above doorway 10. The left-side lag panel 20 is generally parallel to lead panel 18 and is suspended between it and wall 40. Lag panel 20 includes a second upper edge seal 50, a second lower edge seal 52, rear sealing surface 46, and a second trailing edge seal 54, which upon panel 20 closing respectively engage a second upper sealing surface 56 attached to wall 40, lower sealing surface 42, first trailing edge seal 36 of lead panel 18, and a second rear sealing surface 58 attached to wall 40. A similar sealing arrangement is provided for the right-side panels 18 and 20.

Generally, then, the sealing mechanism for the various edges of the door panels are characterized by a first sealing member carried on the panel itself, such as seals 30, 32, 36, 44, 50, 52 and 54. A second sealing member is disposed relative to the moving panel such that the first sealing member and the second sealing member are in engagement when (and preferably only when) the panel is in its doorway blocking position. The second sealing member may be stationary, such as seals 38, 56, 58 and 42. However, the second sealing member may also be moveable, but arriving at its proper position relative to the first sealing member as the panel carrying the first sealing member gets to its doorway-blocking position. Seal 46 is one example of a moveable second sealing member.

To seal certain corners of the door panels some intersecting seals are joined to create various corner seals. For example first upper edge seal 30 intersecting trailing edge seal 36 creates a first corner seal 60 for lead panel 14 (FIG. 3). Second upper edge seal 50 intersecting second trailing edge seal 54 creates a second corner seal 62 for lag panel 16. Second corner seal 62 sealingly engages a mating third corner seal 64 created by the intersection of second upper sealing surface 56 and second rear sealing surface 58.

Figure 6:
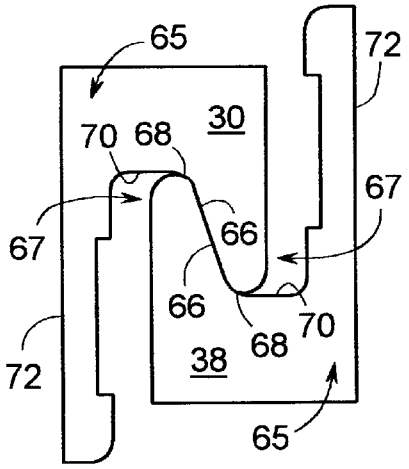
FIG. 6 is an end view of two seals in one position.
Figure 7:
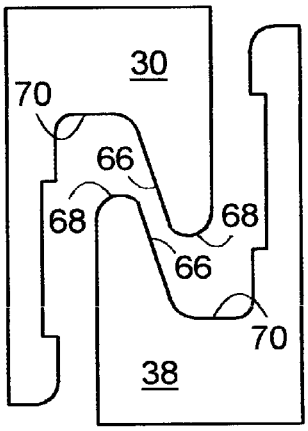
FIG. 7 is an end view of the seals of FIG. 6, but in another position.
Figure 8:
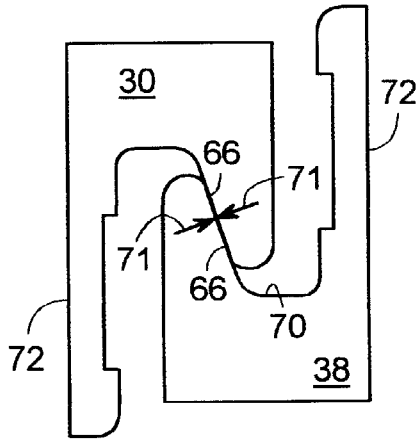
FIG. 8 is an end view of the seals of FIG. 6, but in yet another position.

For effective sealing even with some seal misalignment in directions both perpendicular and parallel to a door panel, edge seals 30, 36, 50 and 54 and comparable sealing surfaces 38, 46, 56 and 58 are each of a geometry that provides a compressive force between sealing surfaces that is outside the plane of movement of the panel or panels being sealed. The nature of this compressive force will be detailed below. In this embodiment, the compressive force is provided by the seal members being comprised of a somewhat L-shaped or U-shaped unitary piece of neoprene foam with ample compliance and resilience. The specific geometry of a seal or sealing surface can vary; however, an exemplary set of mating seals 30 and 38 are shown in FIGS. 6, 7 and 8.

In this example, seals 30 and 38 each include a lip sealing surface 66 interposed between an attachment end 65 and a distal end 67, with end 65 being adapted to attach to a door panel or be attached in fixed relationship relative to doorway 10. When end 65 is attached to a door panel, lip sealing surface 66 is preferably facing the panel. A lip sealing surface is "facing the panel" when a line normal to the lip sealing surface projects through the plane along which the panel sweeps, such as plane 15 or 17. In some embodiments, lip sealing surface 66 is situated between a tip surface 68 and a recessed surface 70. When seals 30 and 38 are sealingly engaged as shown in FIG. 6, tip surface 68, lip sealing surface 66 and recessed surface 70 of seal 30 respectively engage recessed surface 70, lip sealing surface 66 and tip surface 68 of seal 38. The same surfaces disengage when the seals completely separate as shown in FIG. 7. In some cases, only sealing surfaces 66 engage while only the tip surfaces 68 and recessed surfaces 70 disengage, as shown in FIG. 8. Consequently, the terms, "engage" and "disengage" are used in a relative sense, in that seals 30 and 38 engage upon moving from the configurations of FIG. 7 or 8 to that of FIG. 6 or upon moving from the configuration of FIG. 7 to that of FIG. 8 or to any position where there exists at least a line contact between the two. Thus, seals 30 and 38 of FIG. 8 may be engaged or disengaged depending upon their previous configuration (i.e., the configuration of FIG. 6 or 7). In the case where seal 30 is attached to a first panel and at least partially engages seal 38 when stationary or attached to a second panel, the lip sealing surfaces 66 face each other. And sealing surface 66 of seal 30 positions distal end 67 of seal 38 between attachment end 65 of seal 30 and at least one of the first panel or the attachment end 65 of seal 30. The same applies to corner seals 60, 62 and 64 in that they each have facing sealing surfaces 66, however, the engagement of their sealing surfaces create an L-shaped pattern of contact.

The geometry of the seal members just described provides a compressive force 71 between sealing surfaces that is outside the plane of panel movement. Seal members 30 and 38 includes overlapping lip sealing surfaces 66 with one or both disposed at an angle relative to a mounting surface 72. In this example, mounting surface 72 is generally parallel to the plane of movement of the panel on which the seal is mounted. Engagement of seals 30 and 38 results in compressive force 71 being directed generally perpendicular to sealing surfaces 66 and at an angle (i.e., between zero and ninety degrees) to the plane of panel movement. Compressive force 71 in conjunction with seal 30 and/or 38 results in energy being stored at lip sealing surfaces 66 to enhance sealing. Moreover, compressive force 71 being at an angle helps draw seal members (or the movable panels to which they may be attached) toward each other in their proper position to ensure that mating seals fully engage each other. Thus, compressive force 71 may enhance sealing and/or assist in proper seal or panel alignment.

The operation of door 12 and its seals is more clearly understood by first referring to the door's open position shown in FIGS. 1 and 4. From this position, a drive unit 80 moves lead panels 14 and 18 toward the center of doorway 10 to close door 12. Drive unit 80 can be any of a wide variety of known mechanisms for operating a sliding door. However, in one embodiment, drive unit 80 includes a timing belt 82 disposed about two cogged sheaves 84 and 86. Sheave 86 is driven by a motor 88 through a gear reduction 90 and a clutch 92, while sheave 84 serves as an idler. One clamp 94 couples trolley 22*a* of panel 14 to move with an upper portion of belt 82, and another clamp 96 couples trolley 22*f* of panel 18 to move with a lower portion of belt 82. Thus, depending on the rotational direction that motor 88 turns sheave 86, panels 14 and 18 move together to close the door or apart to open it. Sheave 86 turning counter clockwise (as viewed looking into FIG. 3) moves belt 82 to pull lead panels 14 and 18 toward each other. According to an aspect of the invention, lag panels 16 and 20 are moved to the closed position by virtue of being coupled to the movement of the associated lead panels 14 and 18 respectively. Alternative structure for achieving this is shown in FIG. 5. In closing the left half of door 12, lead panel 18 pulls lag panel 20 by way of seal 36 on panel 18 engaging seal 46 on panel 20. This requires seals 36 and 46 to be formed of material with sufficient rigidity to transfer some of the momentum of lead panel 18 to lag panel 20, and thus be used to transmit the pulling load necessary to close the door. However, the material of the seals is also preferably soft enough to provide effective sealing. For the right half of door 12, lag panel 16 also starts moving to a closed position, as shown in FIG. 5, upon taking up the slack in a link 98 that couples lag panel 16 to lead panel 14. Link 98 can be any one of a variety of connections that couple the motion of one panel to another. Examples of link 98 include, but are not limited to, a rigid sliding link or an elongated pliable member such as a strap, chain or cable. Alternatively, a more complex linkage and auxiliary drive for the lag panel can be employed, as disclosed in U.S. patent Ser. No. 09/394,789 filed concurrently and herewith incorporated by reference. Although only one link 98 is shown in the drawing figures, another link 98 may be added to connect panel 18 to panel 20 on the left side of door 12, which would allow lead panel 18 to pull lag panel 20 back to the unblocking position. With link 98 being pulled tight and trailing edge seal 36 engaging rear sealing surface 46 on both the right and left side of door 12, all four panels 14, 16, 18 and 20 are able to move in front of doorway 10 to close door 12.

Figure 9:
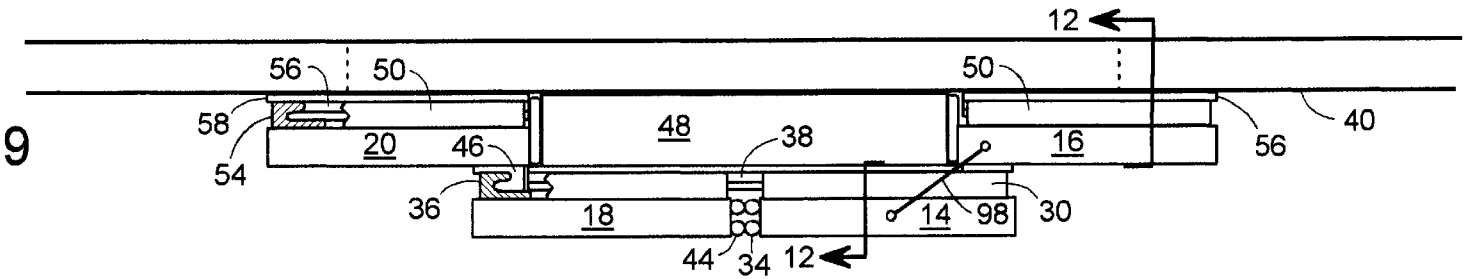
FIG. 9 is a top view similar to that of FIG. 4, but showing the door in its closed position.
Figure 11:
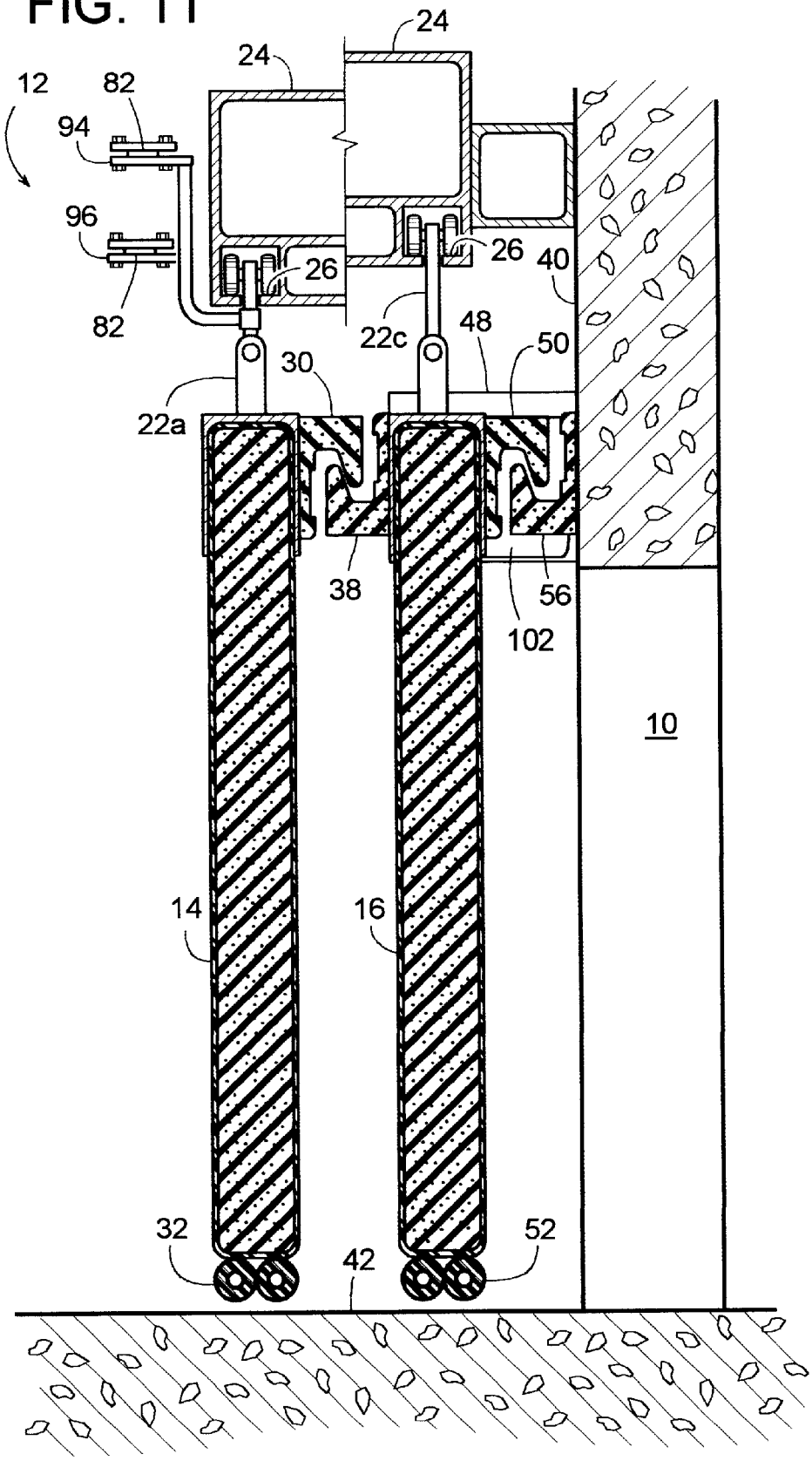
FIG. 11 is a cross-sectional end view taken along line 11—11 of FIG. 5.
Figure 12:
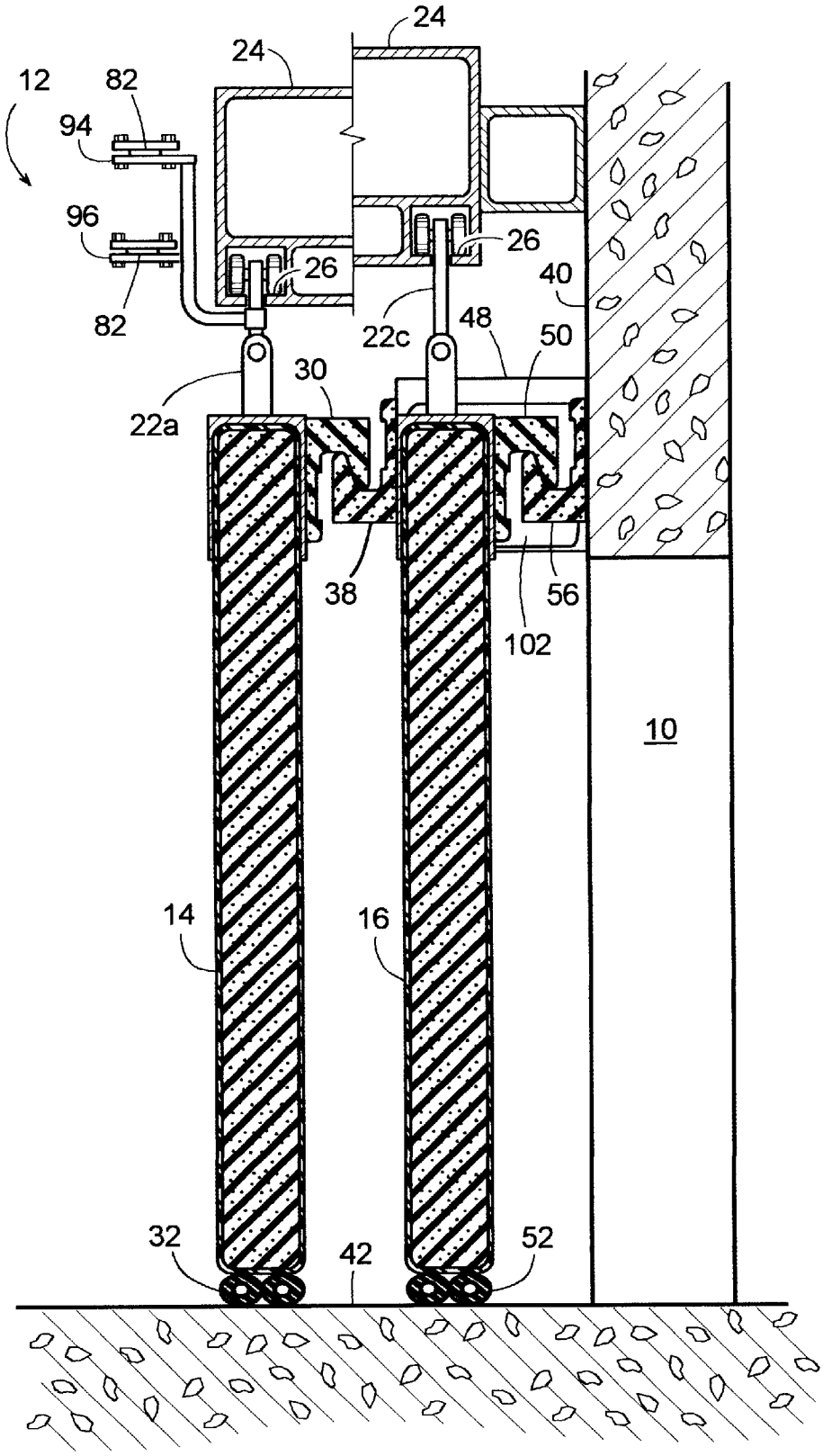
FIG. 12 is a cross-sectional end view taken along line 12—12 of FIG. 9.

As door 12 moves to its closed position, upper edge seals 30 and 50 travel across upper sealing surfaces 38 and 56 respectively, but remain relatively disengaged as shown in FIG. 11 (With track 24 being inclined, an unusual vertical shift appears down the center of track 24 of FIG. 11 due to the cross-sectional view being taken across two different elevations of the track.). Upon reaching the closed position of FIG. 9, leading edge seal 34 of panel 14 abuts forward sealing surface 44 of panel 18. And the movement of panels 14, 16, 18 and 20 down inclined track surfaces lowers the lower edge seals 32 and 52 onto the floor below doorway 10 and lowers the upper edge seals 30 and 50 into sealing engagement with the upper sealing surfaces 38 and 56, as shown in FIGS. 9 and 12. The same occurs on the left side of the door. In this embodiment, leading edge seal 34, forward sealing surface 44, and lower edge seals 32 and 52 are resilient, compressible polyurethane foam tubes, however a variety of other known seals are well within the scope of the invention. Since rear sealing surface 46 is spaced apart from the second upper edge seal 50, a span or gap 100 between the two is sealed by a span seal 102 (FIG. 5). Span seal 102 can be attached to either end of lintel 48 to engage the leading edges of panels 16 and 20 as shown, or attached to the leading edges of panels 16 and 20 to engage the ends of lintel 48. As with the other seals, span seal 102 is a compressible, resilient neoprene foam.

Figure 10:
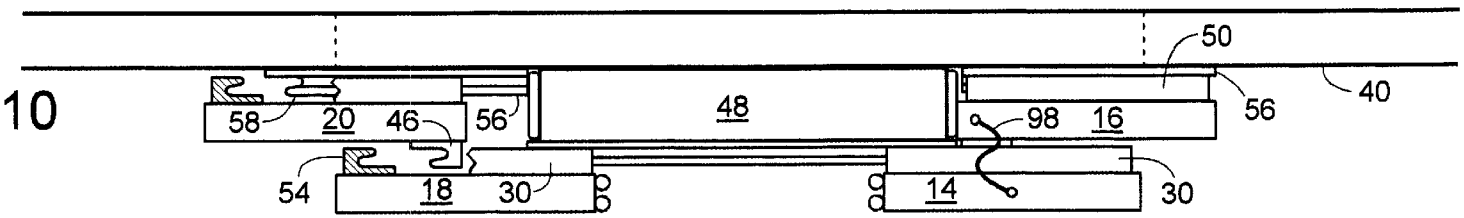
FIG. 10 is a top view similar to that of FIG. 5, but with the door moving to its open position.

To open door 12, the operation of the door panels and the seals is basically the opposite of closing. Drive unit 80 pulls lead panels 14 and 18 away from the center of doorway 10, which first slackens link 98 as shown in FIG. 10. But as panels 14 and 18 continue to open, link 98 eventually retightens to pull lag panels 16 and 20 back out to the open position as shown in FIG. 4. In the case where lag panel 20 was closed by engagement of its leading edge seal 46, an alternative means for moving the rear panel may be employed, such as the auxiliary drives from the earlier-mentioned and incorporated U.S. application Ser. No. 09/394,799. The outward horizontal movement of panels 14 and 16 separates seals 34, 36 and 54 from sealing surfaces 44, 46 and 58 respectively. And the vertical movement of panels 14 and 16 as they travel along track 24 lifts seals 30, 32, 50 and 52 away from sealing surfaces 42, 38, 56 and 42 respectively.

To guide the lower edges of the door panels and to prevent a pressure differential across the door from deflecting the door excessively, each panel is associated with a slide 184*a–d* that slides along a slide restraint 186*a–d*. For the embodiment of FIGS. 1–3, each slide 184*a–d* is steel ring, and each slide restraint 186*a–d* is an elongated nylon strap 188 threaded through one of the rings and anchored at each end 190 of the strap. To restrain panel 20, restraint 186*a* is attached to wall 40 with its corresponding slide 184*a* being attached to panel 20. To restrain panel 18, restraint 186*b* is attached to lag panel 20 with its corresponding slide 184*b* being attached to lead panel 18. To restrain panel 14, restraint 186*c* is attached to lag panel 16 with its corresponding slide 184c being attached to lead panel 14. To restrain panel 16, restraint 186d is attached to wall 40 with its corresponding slide 184*d* being attached to panel 16. For this exemplary embodiment, each ring is attached to its appropriate panel by way of a short strap 190. Although the actual structure of the slides and slide restraints can vary, in some embodiments it is preferable to use a strap and ring design. With such a design, if a vehicle strikes door 12, the flexibility of strap 188 allows a door panel to yield without breaking either a panel or the slide restraint. And a slide that encircles the strap will remain engaged with its strap even during a collision. Thus after the collision, the door panel, its slide and slide restraint should all automatically return to their normal operating conditions. In some applications, however, it may be desirable to make the slide from a ring or S-hook of marginally adequate strength to serve as a relatively inexpensive "weak link." In the event of a severe collision, the weak link breaking away could prevent damaging something more expensive. It should be noted that an obvious variation to the embodiment just described, would be to attach slides 184*a*, 184*b*, 184*c* and 186*d* to wall 40, panel 20, panel 16 and wall 40 respectively, and mount their corresponding slide restraints 186*a*, 186*b*, 186*c* and 186*d* to panel 20, panel 18, panel 14 and panel 16 respectively. In other words, just exchange the mounting positions of the slides with those of the slide restraints, and vice versa.

Figure 13:
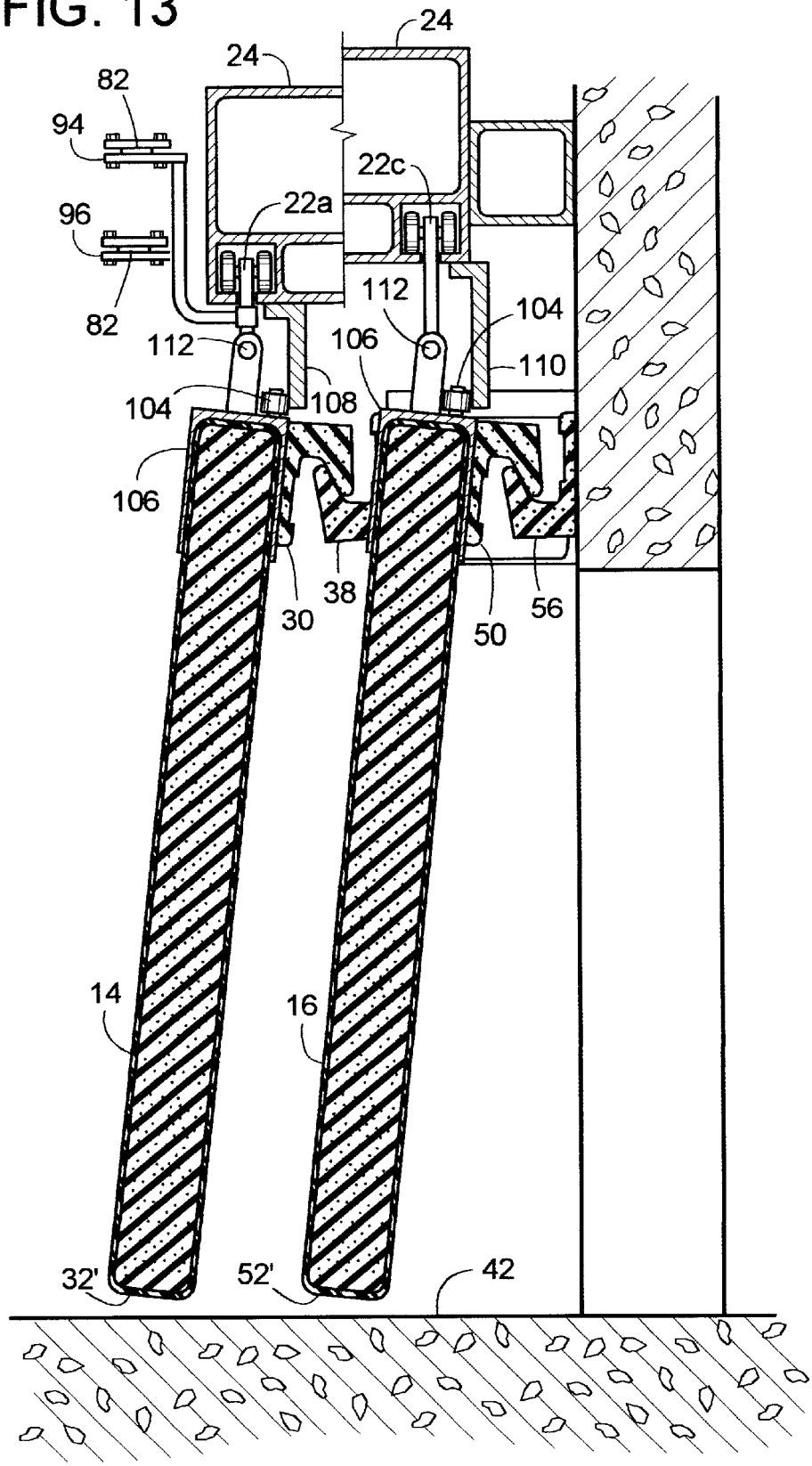
FIG. 13 is a cross-sectional end view similar to that of FIG. 11, but with a panel-tilting feature.
Figure 14:
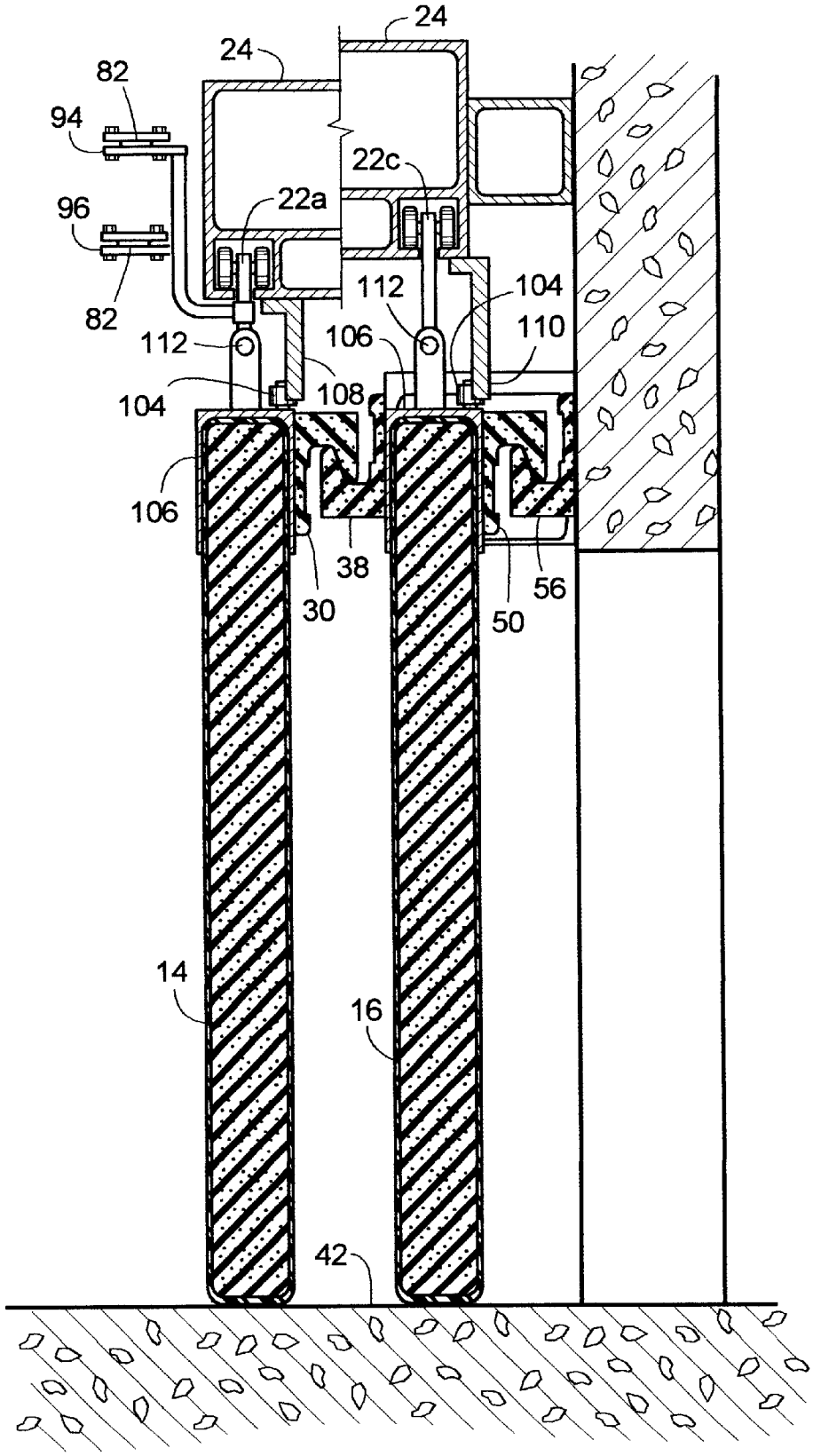
FIG. 14 is a cross-sectional end view similar to that of FIG. 12, but with the same panel-tilting feature shown in claim 13.

Although the primary benefit of an angled track is reduced wear on the lower seal, the same result can be achieved by tilting the panels away from the floor as the door moves toward the closed position or as it just begins to open. In the embodiment of FIGS. 12 and 13, for example, a reaction member such as a cam roller 104 is attached to each upper frame 106 of panels 14 and 16. As trolleys 22*a* and 22*c* travel along track 24, cam rollers 104 ride over cam surfaces 108 and 110, which are fixed relative to track 24. This causes rollers 104 to urge panels 14 and 16 to pivot about a hinge 112 to tilt panels 14 and 16 away from lower sealing surface 42 (e.g., the floor), as shown in FIG. 13. Once the door is at its closed position, a relieved portion of the cam surfaces 108 and 110 guide rollers 104 to a position that allows panels 14 and 16 to swing back down into engagement with the floor, as shown in FIG. 14. It should be noted that lower edge seals 32' and 52' in this example, are provided simply by a lower edge that is integral to panels 14 and 16. Also, one of skill in the art will appreciate that the specific structure of upper seals 30, 50, 38, and 56 may need to be modified to take the rotational motion of the panel into account.

Although the invention is described with reference to a preferred embodiment, it should be appreciated by those skilled in the art that various modifications are well within the scope of the invention. Therefore, the scope of the invention is to be determined by reference to the claims that follow.

We claim:

1. A door for at least partially covering a doorway defined by a wall and a lower surface, comprising:

a first door panel adapted to laterally translate along a plane relative to the doorway between a doorway blocking position and an unblocking position;

a first seal including a first sealing surface interposed between a first attachment end and a first distal end with the first attachment end being attached to the first door panel; and a second seal disposed to allow relative movement between the first seal and the second seal, the second seal including a second sealing surface interposed between a second attachment end and a second distal end, such that the first door panel in the doorway blocking position causes the first sealing surface to face the second sealing surface and positions the second distal end between the first distal end and at least one of the first door panel and the first attachment end, wherein both the first sealing surface and the second sealing surface are tilted relative to the plane.

2. A door for at least partially covering a doorway defined by a wall and a lower surface, comprising:

a first door panel adapted to laterally translate along a plane relative to the doorway between a doorway blocking position and an unblocking position;

a first seal including a first sealing surface interposed between a first attachment end and a first distal end with the first attachment end being attached to the first door panel;

a second seal disposed to allow relative movement between the first seal and the second seal, the second seal including a second sealing surface interposed between a second attachment end and a second distal end, such that the first door panel in the doorway blocking position causes the first sealing surface to face the second sealing surface and positions the second distal end between the first distal end and at least one of the first door panel and the first attachment end, and a second door panel adapted to laterally translate along a second plane substantially parallel to and offset out of coplanar alignment with the first plane, wherein the second seal is disposed on the second door panel.

3. A door for at least partially covering a doorway defined by a wall and a lower surface, comprising:

a first door panel adapted to laterally translate along a plane relative to the doorway between a doorway blocking position and an unblocking position;

a first seal including a first sealing surface interposed between a first attachment end and a first distal end with the first attachment end being attached to the first door panel;

a second seal disposed to allow relative movement between the first seal and the second seal, the second seal including a second sealing surface interposed between a second attachment end and a second distal end, such that the first door panel in the doorway blocking position causes the first sealing surface to face the second sealing surface and positions the second distal end between the first distal end and at least one of the first door panel and the first attachment end, a third seal, and a fourth seal disposed on the first door panel and spaced from the first seal to define a gap therebetween, wherein the first seal is elongated horizontally, the fourth seal is elongated vertically, and the third seal horizontally spans the gap when the first door panel is in the doorway blocking position.

4. The door of claim 3, wherein the third seal is adapted to be substantially fixed relative to the doorway.

5. A door for at least partially covering a doorway defined by a wall and a lower surface, comprising:

a first door panel adapted to laterally translate along a plane relative to the doorway between a doorway blocking position and an unblocking position; and a slide disposed on an elongated slide restraint to provide relative sliding motion therebetween, wherein the slide and elongated slide restraint are adapted to be spaced above the lower surface and at least one of the slide and the elongated slide restraint is attached to a first lower portion of the first door panel to limit movement of the first lower portion out of the plane.

6. The door of claim 5, further comprising:

a first seal including a first sealing surface interposed between a first attachment end and a first distal end with the first attachment end being attached to the first door panel; and a second seal disposed to allow relative movement between the first seal and the second seal, the second seal including a second sealing surface interposed between a second attachment end and a second distal end, such that the first door panel in the doorway blocking position causes the first sealing surface to face the second sealing surface and positions the second distal end between the first distal end and at least one of the first door panel and the first attachment end.

7. The door of claim 5, wherein the slide fully encircles the elongated slide restraint.

8. The door of claim 5, wherein the elongated slide restraint is pliable.

9. The door of claim 5, wherein the slide is attached to the first door panel.

10. The door of claim 5, wherein the elongated slide restraint is attached to the first door panel.

11. The door of claim 5, further comprising a second door panel substantially parallel with the first door panel and being displaced out of coplanar alignment therewith, such that the first door panel and the second door panel both move in a first direction to close the door and both move in a second direction to open the door, wherein the slide and the elongated slide restraint couple the first lower portion of the first door panel to a second lower portion of the second door panel to limit an extent to which the second door panel can be displaced out of coplanar alignment with the first door panel, yet still allow the door to open and close.

12. A door moveable between a doorway blocking position and an unblocking position relative to a doorway defined by a wall and a lower surface, comprising:

a first door panel disposed along a plane and adapted to laterally translate relative to the doorway between the doorway blocking position and the unblocking position;

a second door panel adapted to laterally translate relative to the doorway between the doorway blocking position and the unblocking position;

a first seal disposed adjacent a trailing edge of the first door panel;

a second seal disposed adjacent a leading edge of the second door panel and engaging the first seal with the door in the doorway blocking position and spaced from the first seal with the door in the unblocking position, wherein at least one of the first seal and the second seal are sufficiently pliable to effectively seal therebetween, and wherein the first seal and the second seal are of sufficient rigidity to transfer momentum from the first door panel to the second door panel as the door moves from the unblocking position to the doorway blocking position, whereby the first seal engaging the second seal allows the first door panel moving to the doorway blocking position to pull the second door panel to the doorway blocking position.

13. The door of claim 12, wherein the first seal includes a first sealing surface interposed between a first attachment end and a first distal end with the first attachment end being attached to the first door panel, and wherein the second seal includes a second sealing surface interposed between a second attachment end and a second distal end, such that the first door panel in the blocking position causes the first sealing surface to face the second sealing surface and positions the second distal end between the first distal end and at least one of the first door panel and the first attachment end.

* * * * *

UNITED STATES PATENT AND TRADEMARK OFFICE

CERTIFICATE OF CORRECTION

PATENT NO. : 6,330,763 B1
DATED : December 18, 2001
INVENTOR(S) : Kern et al.

It is certified that error appears in the above-identified patent and that said Letters Patent is hereby corrected as shown below:

Column 6,
Line 14, after "…as disclosed in U.S.," delete "patent" and insert -- Patent --.
Line 14, after "Ser. No." delete "09/394,789" and insert -- 09/394,799 --.

Signed and Sealed this

Twenty-first Day of January, 2003

JAMES E. ROGAN
*Director of the United States Patent and Trademark Office*